US005333730A

United States Patent [19]

Boyd

[11] Patent Number: 5,333,730

[45] Date of Patent: Aug. 2, 1994

[54] BAG PACK AND SYSTEM FOR SUSPENDING AND DISPENSING BAGS

[75] Inventor: Dana M. Boyd, Rushville, N.Y.

[73] Assignee: Mobil Oil Corporation, Fairfax, Va.

[21] Appl. No.: 40,172

[22] Filed: Mar. 31, 1993

[51] Int. Cl.[5] ..... B65D 27/10

[52] U.S. Cl. ..... 206/554; 383/7; 383/37

[58] Field of Search ..... 206/526, 554, 495; 383/7, 9, 37

[56] References Cited

U.S. PATENT DOCUMENTS

| | | | |
|---|---|---|---|
| 3,380,579 | 4/1968 | Pinto | 206/554 |
| 3,915,302 | 10/1975 | Farrelly et al. | 206/554 |
| 4,480,750 | 11/1984 | Daney | 206/526 |
| 4,676,378 | 6/1987 | Baxley et al. | 383/9 |
| 4,796,759 | 1/1989 | Schisler | 206/554 |
| 5,183,158 | 2/1993 | Boyd et al. | 383/37 |

FOREIGN PATENT DOCUMENTS

| | | | |
|---|---|---|---|
| 423729 | 4/1991 | European Pat. Off. | 206/554 |
| 1341587 | 9/1963 | France | 206/554 |

*Primary Examiner*—David T. Fidei
*Attorney, Agent, or Firm*—Alexander J. McKillop; Malcolm D. Keen; L. Gene Wise

[57] ABSTRACT

Plastic bags made of film are suspended in a pack on a rack having support rods for suspending the bags by their handles. During removal of a lead bag from the pack, adhesive contact causes opening of the next bag.

13 Claims, 2 Drawing Sheets

BAG PACK AND SYSTEM FOR SUSPENDING AND DISPENSING BAGS

BACKGROUND OF THE INVENTION

The handling of plastic grocery sacks at the front end of supermarkets is a continuing problem and the industry is constantly on the look-out for systems which permit the most facile handling of such grocery sacks.

In U.S. Pat. No 4,796,759 to Schisler there is provided a hole in each handle of the bags of a bag pack. A center support tab extends from the mouth of each bag and the tabs are joined together by welding or gluing to secure the bags in a pack. A line of perforations separate the support tab from the bag mouth. Below the perforation of each line of each bag is a "glued or welded localized zones 9" which insures connection between the rear wall of one bag and the front wall of any next bag. Above this point 9, the welded-together support tabs maintain the bags in registration and the localized glued or welded zones 9 assist in opening the bags during the dispensing and loading of the same. The construction includes the disadvantage that no provision is made for maintaining the handles in registration.

It is an object of the present invention to present a system employing a pack of double-film loop handled bags which can be dispensed from a rack employing two generally parallel horizontal rods. During the dispensing of such bags it is a principal object of the present invention to at least partially open a succeeding bag upon the removal of a lead bag from such a pack.

SUMMARY OF THE INVENTION

The present invention is concerned with a pack of thermoplastic film bags, said bags being in at least approximate registration, each bag comprising a bottom, front and rear walls connected by way of gusseted side walls, a bag mouth, double film loop handles at opposite ends of the bag mouth, said handles comprising integral extensions of said walls; each bag having at least one easily severable comparatively small area thereof in adhesive contact with an area of an adjacent bag, the aggressiveness of said adhesive to said area of an adjacent bag being greater than a force sufficient to severe said easily severable area such that on movement of a lead bag away from said pack, the next following bag will at least partially open before or simultaneously with severance of said easily severable area.

The present invention is also concerned with a system for suspending and dispensing thermoplastic film bags comprising in combination:

a) a pack of said bags, said bags being in at least approximate registration, each bag comprising a bottom, front and rear walls connected by way of gusseted side walls, a bag mouth, double loop handles at opposite ends of said mouth, said handles comprising integral extensions of said walls, said handles having suspension means about intermediate the top and the base of said handles; each bag having at least one easily severable comparatively small area thereof in adhesive contact with a corresponding area of an adjacent bag, the aggressiveness of said adhesive being greater than the force necessary to severe said easily severable area;

b) a rack for said bag pack comprising a pair of spaced parallel cantilevered handle support rods having free ends, said rods functioning to support said pack from said handle suspending means; and c) whereby on removal of the lead bag from the rack-suspended pack, said adhesive contact first causes at least a partial opening of the next bag and thereafter said easily severable area is severed by a combination of the force of removal and the resistance provided by the rack and pack.

DETAILED DESCRIPTION OF THE INVENTION

Figure 1:
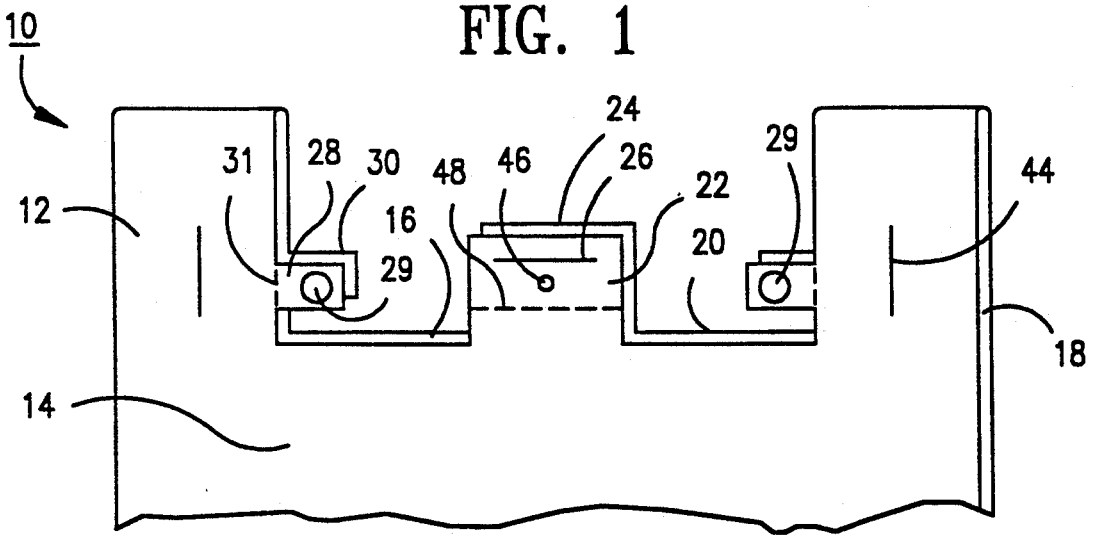
FIG. 1 is a partial perspective view of the first bag of a bag pack according to the invention.
Figure 2:
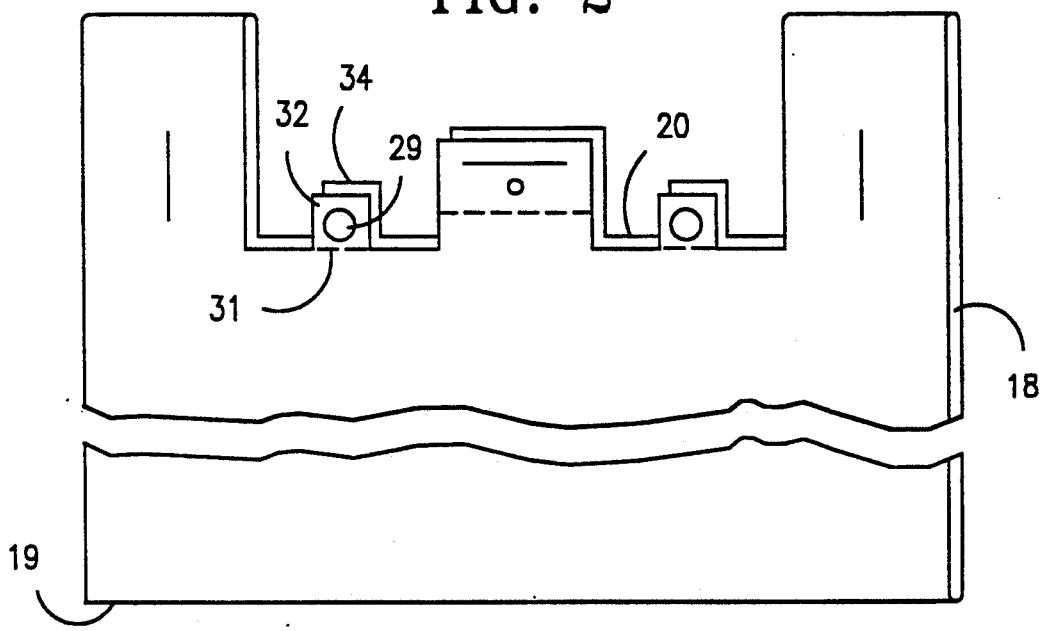
FIG. 2 is a partial perspective view of a variant form of the first bag of a bag pack according to the invention.

In FIG. 1 there is shown a partial segment of a bag pack 10. The segment represents the upper half of the first bag of a plurality of bags assembled in registration one on top of the other. Each bag has double film loop handles 12 as integral extensions of the front rear and side walls of the individual bags. Front wall 14 extends down to the bottom 19 of the bag as shown in FIG. 2. Not fully shown is a more or less identical rear wall 16 at the rear side of the bag. Each bag has gusseted side walls 18 at opposite sides of the bag. This gusseted feature yields double film loop handles 12 when the upper portion of a gusseted tube is cut out to form the handles, the bag mouth 20 and the suspension tabs 22 and 24 of individual bags. The bag mouth region of the bag extends from between the base of the handles from one side to the other after individual bags are separated from front suspension tab 22 and rear suspension tab 24. This separation occurs along a severing line of weakness 48 which is located across the suspension tabs of the bag pack. This line of weakness can be a perforation line or any other type of pre-weakened means. Located near the top of the suspension tabs is an orifice 26 which extends through all tabs and is designed to receive a suspension tongue or tab such as that shown at 52 in FIG. 6. The plurality of bags which make up the pack of bags can optionally be held in registration through a bonded region 46 placed in the suspension tab. It is to be understood that this bonding means can be in the handles or elsewhere in the bag structure so long as it keeps the handles in registration.

FIG. 1 also shows, extending from the inboard region of handles 12, pairs of tabs 28 and 30. The front part of handle 12 will have two superimposed tabs 28 and the rear of handle 12 will have two superimposed tabs 30. The opposite handle will also have the same structure. Placed on the front tab 28 is a pressure sensitive adhesive area 29. This also appears on the opposite tab of handle 12. Any pressure sensitive adhesive can be employed so long as it is of greater aggressive strength than the force needed to separate the easily separable areas. The rear tab 30 does not carry an adhesive area as long as there is an adhesive area on front tab 29. This arrangement can be reversed, that is, no adhesive on front tab 28 but an adhesive area on rear tab 30.

Shown in all of the Figures is suspension means 44 located at each of the handles. Means 44 is shown as a slit which functions to support the bag pack from a rack structure such as that shown in FIG. 6, where parallel rods 50 extend through suspension means 44. Tabs 28 are easily severed from handles 12 by means of perforations 31.

The structure of the bag pack shown in FIG. 2 is the same as that in FIG. 1 except the easily severable tabs 32 and rear tab 34 extend upwardly from bag mouth 20 rather than from the handles. Tab 32 has a pressure sensitive adhesive 29 located therein.

Figure 3:
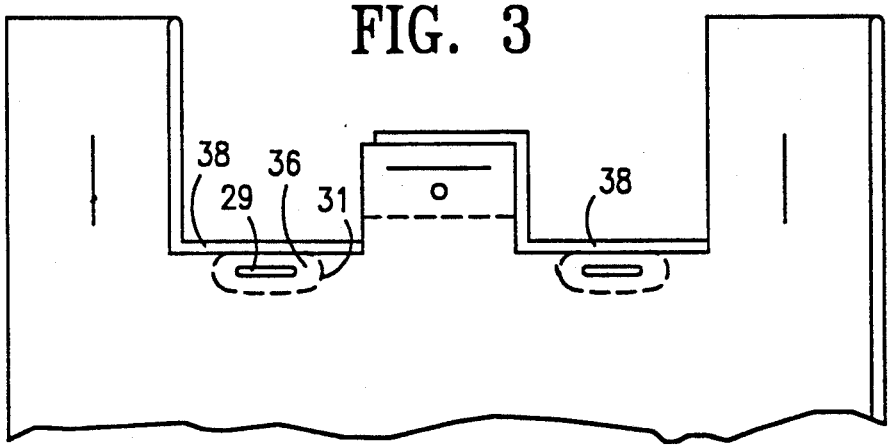
FIG. 3 is a partial perspective view of still another variant form of a bag pack according to the invention.

FIG. 3 illustrates another variation of the bag pack structure where the easily severable region 36 is located in the front of each bag just below the bag mouth region. Area 36 is easily severable by virtue of a perforation line 31 which scribes part of a circle. As in the other Figures a pressure sensitive adhesive is located at a central point in area 36. A non-easily severable region 38 is located in a corresponding location in the rear wall of the bag.

Figure 4:
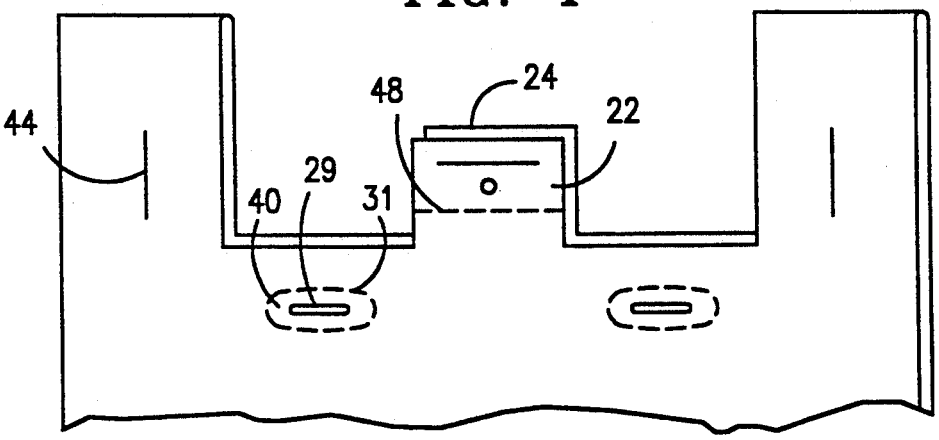
FIG. 4 is a partial perspective view of still another variant form of the first bag of a pack of bags according to the invention.

In FIG. 4 yet another variation is shown where easily severable area 40 is located in the front wall of each bag at two points located just below the bag mouth. Again, severable area 40 is easily removed because of the perforated area 31 which encircles area 40. In the center of area 40 is a pressure sensitive adhesive 29.

Figure 5:
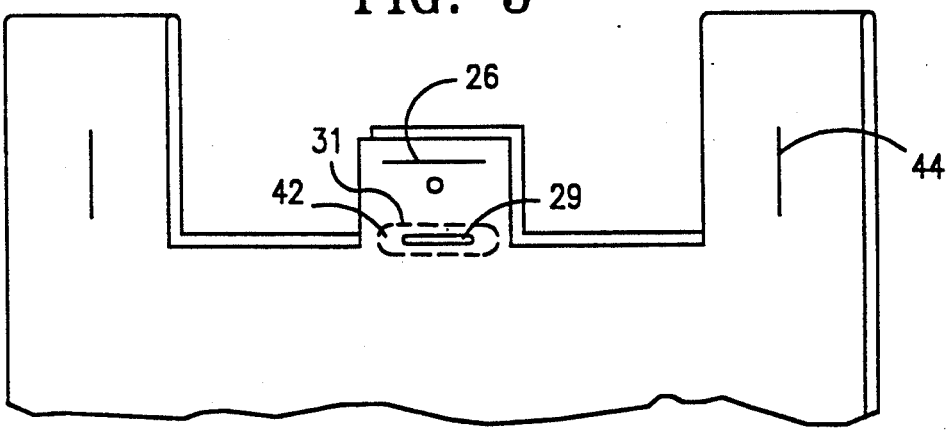
FIG. 5 is a partial perspective view of the first bag of a bag pack of yet another variant form of the bag of the present invention.

In FIG. 5 an easily severable area 42 is located in the front suspension tab and the area is circumscribed by a perforation line 31. Easily removable area 42 has a pressure sensitive adhesive 29 located in the center thereof.

Figure 6:
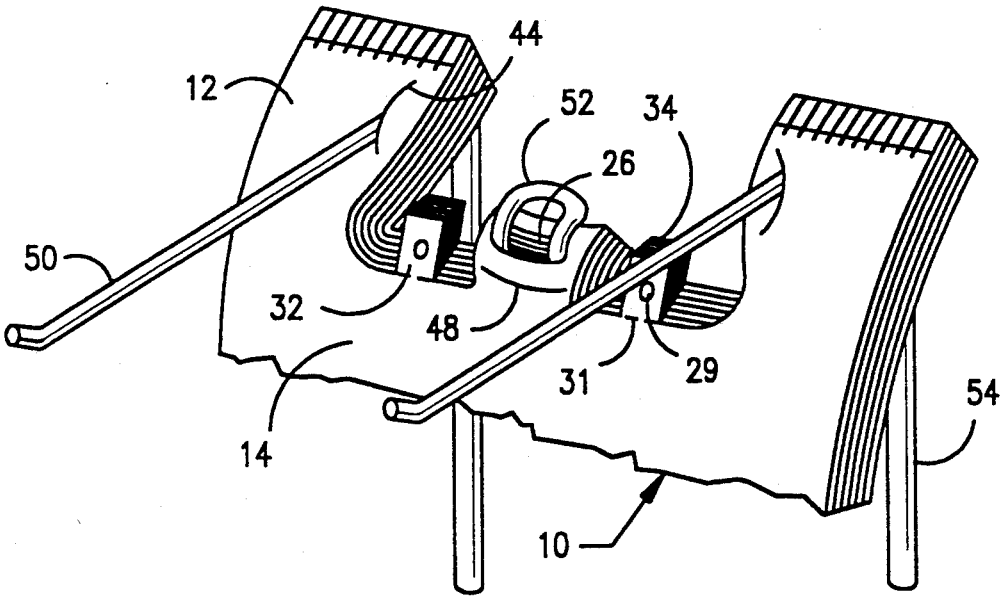
FIG. 6 is a perspective view of the upper half of a pack of bags of the present invention shown suspended from a dispensing rack within the scope of the present invention.

In FIG. 6 there is illustrated a pack of bags 10 (partially shown) which is suspended from a bag rack of the type commonly employed in supermarkets today. Support rods 54 are vertically positioned at the end of a check out counter and they have cantilevered therefrom suspension rods 50 which are horizontal disposed with respect to the floor of the supermarket. The rods are generally parallel to each other and spaced approximately the same distance apart as are the handles 12 of the bag pack. The bag pack is threaded on to support rods 50 by way of orifices 44 located in each handle. The suspension tabs located in the central bag mouth region of the bag pack is positioned onto suspension member 52 through header suspension orifice 26. During manufacture of the bag packs, a thermoplastic film tubular member is gusseted on opposite sides thereof and collapsed into a lay flat condition. The tube is sealed transversely thereof by heat so that a bag length distance is between seals. The sealed tube is then subjected to the effect of differential speed rollers which separates the tube into what is known as end-sealed gusseted pillow cases. The pillow cases are then stacked to the appropriate number desired, e.g., 75, 100, 125, etc., and either in-line or at a remote location, a cutting device cuts one end of the stack so as to remove plastic leaving the shape of handles, a bag mouth and center suspension tabs in the bag pack. It is during these operations that the structure of bags shown in the several figures is created. The pressure sensitive adhesive can be placed at the proper location in the individual bags either before or after the easily severable areas are defined. For example, just prior to stacking the pillow cases a small dot of pressure sensitive adhesive can be located on the pillow case so that thereafter when the cutting mechanism defines the handles and bag mouth structure, the easily severable area can also be formed about the dot of pressure sensitive adhesive.

Since the adhesive is located preferably on one side of the bag, i.e., either on the front or on the back, then when the pillow cases are stacked, the pressure sensitive adhesive dot will contact a corresponding region of the preceding bag. The degree of perforations in association with the easily severable area is matched to the aggressiveness of the adhesive so that when a preceding bag is separated from a following bag, the force of separation is strong enough to free the area having the pressure sensitive adhesive and carry it along with the departing bag. This action will pull open at least partially and, preferably fully, the next bag to be loaded by a bagger in a supermarket.

Thus, in operation a supermarket bagger will load a pack of the defined thermoplastic film grocery sacks on a rack of the type shown in FIG. 6 by threading the handles onto the cantilevered parallel spaced support rods. After accessing the front wall of the first bag and loading the bag with a customer's goods, the bagger will then remove the loaded bag from the rack. During the process of the removal the pressure sensitive adhesive located on the next following bag will adhere to a corresponding region of the departing bag and the force of removal will tear the easily severable area from the next bag and in so doing the front panel of the next succeeding bag will be placed into a partial or fully open condition. This technique overcomes the problem of fumbling with extremely light weight plastic grocery sacks.

Although the present invention has been described with preferred embodiments, it is to be understood that variations and modifications may be resorted to without departing from the spirit and scope of the invention, as those skilled in the art will understand. Such modifications and variations are considered to be within the purview and scope of the appended claims.

What is claimed is:

1. A pack of thermoplastic film bags, said bags being in at least approximate registration, each bag comprising a bottom, front and rear walls connected by way of gusseted side walls, a bag mouth, double film loop handles at opposite ends of the bag mouth and a pair of header tabs extending from the center of each bag mouth, said handles comprising integral extensions of said walls and said bags being secured together by way of a bonded region in said header tabs; each bag further including at least one easily severable, comparatively small, area with an adhesive in contact with a severable area of an adjacent bag, the aggressiveness of said adhesive to said severable area of an adjacent bag being greater than the force sufficient to sever said easily severable area such that on movement of a lead bag away from said pack, the next following bag will at least partially open before, or simultaneously with, severance of said easily severable area.

2. The pack of claim 1 wherein at least one of said header tabs includes said easily severable area.

3. The pack of claim 2 wherein the easily severable area is in the front header tab.

4. The pack of claim 3 wherein said adhesive contact is by means of a pressure sensitive adhesive.

5. The pack of claim 3 wherein said adhesive contact is by means of a co-adhesive on said easily severable area and on an area on the rear header tab of a next preceding bag.

6. The pack of claim 1 wherein at least two easily severable areas extend inwardly toward each other from the lower inboard region of said handles.

7. The pack of claim 6 wherein a pair of oppositely disposed easily severable areas extend from the handles at the front of the bag and a pair of oppositely disposed non-easily severable areas extend from the handles at the rear of the bag in alignment with the front severable areas.

8. The pack of claim 7 wherein said adhesive contact is by means of a pressure sensitive adhesive.

9. The pack of claim 7 wherein said adhesive is by means of a co-adhesive on each of said areas.

10. The pack of claim 1 wherein said at least one easily severable area is located in the front or rear wall of the bag.

11. The pack of claim 10 wherein said at least one easily severable area is located in the front wall adjacent to said bag mouth.

12. The pack of claim 11 wherein said adhesive contact is by means of a pressure sensitive adhesive.

13. The pack of claim 11 wherein said adhesive contact is by means of a co-adhesive.

* * * * *